US009752469B2

(12) United States Patent
Steigerwald et al.

(10) Patent No.: US 9,752,469 B2
(45) Date of Patent: Sep. 5, 2017

(54) SLIDING CAM ACTUATOR HAVING A SEAL

(71) Applicant: Schaeffler Technologies AG & Co. KG, Herzogenaurach (DE)

(72) Inventors: Martin Steigerwald, Herzogenaurach (DE); Jens Hoppe, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/765,499

(22) PCT Filed: Jan. 21, 2014

(86) PCT No.: PCT/DE2014/200015
§ 371 (c)(1),
(2) Date: Aug. 3, 2015

(87) PCT Pub. No.: WO2014/121792
PCT Pub. Date: Aug. 14, 2014

(65) Prior Publication Data

US 2015/0377092 A1 Dec. 31, 2015

(30) Foreign Application Priority Data

Feb. 8, 2013 (DE) ..... 10 2013 202 132

(51) Int. Cl.
*F01L 1/34* (2006.01)
*F01L 9/04* (2006.01)
(Continued)

(52) U.S. Cl.
CPC ..... *F01L 9/04* (2013.01); *F01L 1/047* (2013.01); *F01L 3/08* (2013.01); *F01L 13/0036* (2013.01);
(Continued)

(58) Field of Classification Search
CPC ..... F01L 9/04; F01L 1/047; F01L 13/0036; F01L 3/08; F01L 2001/0473; F01L 2820/031; F01L 2013/0052; H01F 7/128
(Continued)

(56) References Cited

U.S. PATENT DOCUMENTS 4,961,413 A 10/1990 Grey et al.
6,129,062 A 10/2000 Koda
(Continued)

FOREIGN PATENT DOCUMENTS

DE 1890673 U1 4/1964
DE 3721208 A1 1/1989
(Continued)

*Primary Examiner* — Zelalem Eshete
(74) *Attorney, Agent, or Firm* — Davidson, Davidson & Kappel, LLC

(57) ABSTRACT

A sliding cam actuator for a sliding cam system, including a housing defining a housing interior, and at least one coil former having a winding for generating a magnetic force when current flows, further including a moving pin or control pin extendable out of the housing by the magnetic force or a spring force and designed to dip into a displacement groove of a sliding can. A sealing element sealing off the interior of the housing from the outside is arranged between a component fixed to the housing and a component fixed to the moving pin. A sliding cam system including at least one camshaft, on which at least one sliding cam having a displacement groove is arranged such that the sliding cam can be displaced but is fixed against rotation, and into which sliding cam a moving pin of a sliding cam engages is provided.

6 Claims, 3 Drawing Sheets

(51) Int. Cl.

| | |
|---|---|
| ***F01L 3/08*** | (2006.01) |
| ***F01L 13/00*** | (2006.01) |
| ***H01F 7/128*** | (2006.01) |
| *F01L 1/047* | (2006.01) |

(52) U.S. Cl.
CPC ..... *H01F 7/128* (2013.01); *F01L 2001/0473* (2013.01); *F01L 2013/0052* (2013.01); *F01L 2820/031* (2013.01)

(58) Field of Classification Search
USPC ..... 123/90.16
See application file for complete search history.

(56) References Cited

U.S. PATENT DOCUMENTS

| | | | | |
|---|---|---|---|---|
| 6,967,550 | B2 * | 11/2005 | Elendt | F01L 13/0036 123/90.11 |
| 8,136,790 | B2 | 3/2012 | Hoppe et al. | |
| 8,757,585 | B2 | 6/2014 | Bill et al. | |
| 2007/0178731 | A1 | 8/2007 | Elendt | |
| 2010/0126445 | A1 * | 5/2010 | Schiepp | F01L 1/053 123/90.16 |
| 2010/0192885 | A1 | 8/2010 | Golz et al. | |
| 2011/0079741 | A1 * | 4/2011 | Bill | F16K 31/0693 251/129.15 |

FOREIGN PATENT DOCUMENTS

| | | | |
|---|---|---|---|
| DE | 4028289 | | 3/1992 |
| DE | 10 2004 008 670 | | 9/2005 |
| DE | 202007010814 | | 11/2007 |
| DE | 10 2006 034 922 | | 1/2008 |
| DE | 102006059188 | | 6/2008 |
| DE | 10 2007 028 600 | | 12/2008 |
| DE | 102008008118 | A1 | 8/2009 |
| DE | 10 2008 020 892 | | 10/2009 |
| DE | 102008030454 | A1 | 12/2009 |
| DE | 10 2009 015 833 | | 10/2010 |
| EP | 0281192 | | 9/1988 |

* cited by examiner

SLIDING CAM ACTUATOR HAVING A SEAL

The present invention relates to a sliding cam actuator for a sliding cam system, including a housing, which defines a housing interior, and also including at least one coil body, which is situated therein and includes a winding for generating a magnetic force when current flows through it, also including at least one moving pin or contact pin, which is extendable out of the housing by the magnetic force or a spring force and is designed for dipping into a sliding groove of a sliding cam.

The present invention also relates to a sliding cam system, including at least one camshaft on which at least one sliding cam having a sliding groove is situated displaceably and rotatably fixed and in which a moving pin of a sliding cam actuator engages.

Valve trains including cam shifts for gas exchange valves of four-cycle internal combustion engines are already known from the prior art. For example, DE 10 2004 008 670 A1 describes a valve train including a cam shift having the following features and components: a spline shaft having axial external teeth and one cam piece per cylinder, having internal teeth, with the aid of which the cam piece is axially displaceable and connected rotatably fixed to the spline shaft. The cam piece has two cams side by side, having the same base diameter for each gas exchange valve and an unequal lift. Cylindrical end pieces, within whose circumference a sliding groove, designed in mirror symmetry, is cut radially, are provided on both ends of the cam piece. A radially retractable actuator pin, fixed to the housing, is provided in each sliding groove, the cam piece being displaceable back and forth axially while the engine is running through cooperation of actuator pins and sliding grooves, each sliding groove having an acceleration flank including an impact ramp, whose constant low slope causes a corresponding, constant, low axial initial speed of the cam piece and a low impact force of the actuator pins. A corresponding active principle is considered to be generic.

Sliding cam actuators, for example, electromagnetic operating devices, are already known from DE 10 2009 015 833 A1. This describes such a device for use as a cam adjuster for piston engines, having a housing at least partially in the form of a cylindrical pot, in particular made of a magnetically soft metal, including a permanent magnet device secured on the pot bottom in the housing, including a current coil device and a ram-like actuating element, movable axially between a retracted first switching position and an extended second switching position in the housing and including a hollow body situated on the actuating element to hold the actuating element in a first switching position by an attractive magnetic force of the permanent magnet device against the spring force of a spring system acting between the actuating element and an attack area on the housing side; the actuating element moves out of this first switching position and into the second switching position when the coil device is energized and the magnetic force is thereby reduced under the influence of the spring force, the spring system having a decoupling device, with the aid of which the action of the spring force on the housing-side attack area is suppressible in the second switching position.

The prior art, for example, DE 10 2007 028 600 A1, describes an electromagnetic operating device, including a plurality of electromagnetic actuator units, which are selectively adjustable for exerting an actuating power on a corresponding plurality of elongated ram units supported in parallel axially to one another. The actuator units are provided axially in parallel to one another along their actuating direction in a shared housing, each forming an attack surface, which is planar in at least some sections and is movable axially in the actuating direction, on an engagement end facing the ram units. An end face on the engagement side, of one of the respective ram units, cooperates with the engagement surface. Thereby, at least one of the plurality of ram units rests with its engagement-side end surface eccentrically and/or with only a partial surface on the engagement surface of the corresponding actuator unit, in particular adhering to it magnetically. The moving pin is often situated eccentrically in relation to the permanent magnet unit, thus, in other words, adheres magnetically to this permanent magnetic unit. The principle, which is already known in this regard, shall be considered here as being integrated. Usually there are not any additional connections between the permanent magnet unit and the moving pin, so as not to have a negative influence on the functionality.

However, DE 10 2006 034 922 takes a completely different approach in the case of a single-pin actuator and describes an electromagnetic operating device and a method for manufacturing same. A coil device, including essentially a single core made of a magnetic material enclosed by a coil, is described; it has an actuating element movably situated in relation to the coil device and having an engagement area, which is designed to be wear-resistant at the end and with which the actuating element is acted upon by an actuating force via energization of the coil device. Permanent magnet means, via which the actuating element in the unenergized state of the coil device is held magnetically on the coil device, are situated on the actuating element. DE 10 2006 034 922 A1 proposes that a secure and low-wear actuating operation is made possible and nevertheless is implemented inexpensively in a simple design, when decoupling means are provided, via which the actuating element is magnetically decoupled from the permanent magnet means, at least in the engagement area.

DE 10 2008 020 892 A1 also describes an operating device including an actuator pin, which is movable between a retracted holding position and a working position. This actuator pin may also be referred to as a moving pin for adjustment of a machine part. It is described there that a sliding groove cooperating with the actuator pin in its working position is present, which displaces the actuator pin back into its holding position, and that in particular a cam piece of a variable-lift valve train of an internal combustion engine, which is situated rotatably fixed and longitudinally displaceable on a carrier shaft, is provided The operating device has a triggerable holding and releasing device for holding the actuator pin in the holding position and for releasing the actuator pin out of the holding position. The actuator pin is therefore fixed in the holding position by the holding and releasing device with the aid of self-locking locking elements. This publication thus presents a basic principle for a clamping actuator concept.

The switching times, which are a combination of dead times and telescopic times, depend greatly on the temperature because of the viscous friction in the guides of the actuators. This friction is between the moving pin and a moving pin housing and also between an armature and an armature guide, depending on the design. Negative effects on switching times are observable in particular at temperatures below 0° C. As a result, at low temperatures, it is possible to retract into the sliding groove only at lower rotational speeds, so that only a smaller rotational speed window may be utilized.

SUMMARY OF THE INVENTION

In particular due to dirt particles, deposits and oil coking in the guides, the switching time of the actuators increases over the service life. As a result, after a certain actuator running time, it is no longer possible to meet the necessary switching time requirements. At higher rotational speeds, it is impossible to retract into the sliding groove. The function range of the sliding cam system must then be restricted over the lifetime.

It is an object of the present invention to provide a remedy here, to eliminate the disadvantages enumerated above and to prevent an increase in the switching times even at falling temperatures and even over a long service life.

In the case of a generic sliding cam actuator, the present invention provides that a sealing element, sealing the housing interior from the outside, is situated between a component fixed to the housing and a component fixed to the moving pin.

Penetration of dirt particles and deposits into the corresponding guides as well as the formation of oil coking in this area is preventable. If an area near the end of the moving pin (i.e., an area situated near one end of the moving pin protruding out of the housing) is detected as forming a seal, then any penetration of the aforementioned particles may be prevented, whereas in the case of sealing of an area remote from the end of the moving pin, a certain lubrication of the moving pin may still be available but penetration of unwanted particles into the deeper interior of the housing may be prevented.

The sealing element may thus be implemented in a cost-efficient manner if it is designed as a seal and/or as a wiper ring. The seal or the wiper ring may be designed with single or multiple conical tapers with respect to the component, which is movable relative to it. The precision of the structural unit may then be increased and the sealing effect improved.

An advantageous exemplary embodiment is also characterized in that the sealing element is fastened fixed to the housing and is mounted in an active grinding relationship with the component fixed to the moving pin in the case of a relative movement between the latter and the component fixed to the housing. The sealing ring or the wiper ring may then be simply fastened to the housing, so that only the moving pin need be inserted and should be in an active grinding relationship with the sealing ring or the wiper ring. This facilitates the assembly.

To also permit special sliding cam actuator embodiments, it is also advantageous if the sealing element is fastened onto the component fixed to the moving pin and is in an active grinding relationship in the case of a relative movement between the latter and the component fixed to the moving pin.

A particularly good sealing effect is achievable when the sealing element is designed as a bellows.

The function is improved when the bellows is made of rubber and/or metal or the bellows includes rubber and/or metal. Some elasticity may be available due to the use of rubber, and good stability and durability are achieved due to the use of metal.

In order for the sealing effect to also be particularly good, it is advantageous if the expandable bellows is fixedly mounted on the component fixed to the housing as well as on the component fixed to the moving pin, thereby sealing a gap in between.

If the component fixed to the housing is the housing or an armature or an armature guide and/or if the component fixed to the moving pin is the moving pin, the armature or the armature guide, then the sealing effect may be achieved in a suitable and desired location.

It is also advantageous if the armature of the armature guide is fixedly connected to the moving pin or is an integral part of same. The movements in the direction of the longitudinal axis may then be coupled and a particularly efficient active association may be achieved.

It is also advantageous if two or more moving pins are present in the housing, i.e., a multi-pin actuator is implemented.

It should also be pointed out that a sliding cam system is improved according to the present invention by the fact that a sliding cam actuator according to the present invention is used, its moving pin engaging in a corresponding sliding groove or multiple moving pins engaging in corresponding sliding grooves.

In other words, an additional sealing element is provided between the movable part, such as the moving pin, and the stationary part, such as a moving pin guide of the sliding cam actuator. The sealing element prevents oil and dirt from being able to penetrate from the outside into the guide of the actuator. Therefore, the temperature has hardly any effect on the switching times and no significant increase in switching time is to be expected over the entire lifetime.

This approach may be used for all types of sliding cam actuators, such as locking actuators, also when using the "flip-flop" principle, clamping actuators, solenoid actuators and similar components. The sealing element may also be integrated not only between the moving pin and the moving pin housing but, alternatively or additionally, between the armature and the armature guide. In this way, the moving pin, which is under load due to the transverse force during displacement of the cam pin, is lubricated while the relatively unloaded armature is protected from penetrating media and dirt particles.

Constant switching times along with an insensitivity to temperature are ultimately achieved, even over a long service life.

A wiper ring may be integrated into the moving pin housing. The wiper ring then sits securely in the moving pin housing and forms a seal with respect to the movable moving pin. The wiper ring may also be integrated on the moving pin, whereby the wiper ring sits fixedly on the moving pin and executes the same movement as the moving pin accordingly but is sealed with respect to the stationary housing. Integration of the bellows between the moving pin and the moving pin housing is also possible. The bellows is fixedly connected to the moving pin housing on one end and fixedly connected to the moving pin at the other end.

It is particularly advantageous if the wiper ring is designed in such a way that it is able to compensate for the guide play. It is also particularly advantageous when the bellows is designed in such a way that it is able to compensate for a guide play.

BRIEF DESCRIPTION OF THE DRAWINGS

The present invention is also explained in greater detail with the aid of a drawing. Several exemplary embodiments are depicted.

DETAILED DESCRIPTION

Figure 1:
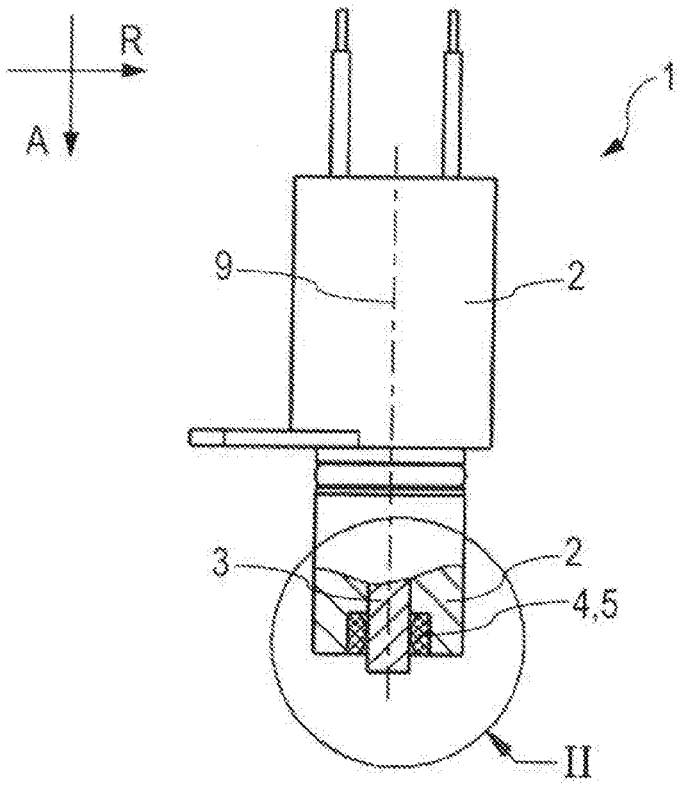
FIG. 1 shows a view from the front onto a sliding cam actuator according to the present invention, having a partially sectional area, in which a moving pin is situated.

The figures are only of schematic nature and merely facilitate an understanding of the present invention. The same elements are labeled with the same reference numerals.

FIG. 1 shows a first specific embodiment of a sliding cam actuator 1 according to the present invention. Sliding cam actuator 1 may be used in a sliding cam system. It has a housing 2, which defines a housing interior. A coil body (not shown) is situated therein.

Housing 2 or a separate component may function as an armature guide. The coil body has a winding through which current may flow. A magnetic force is generated when an electric current flows through the winding. A moving pin 3, which is extendable out of the housing and may also be referred to as a contact pin, is movable by the magnetic force. If moving pin 3 is extended out of housing 2, it may engage in a sliding groove (not shown) of a displacement cam/sliding cam (not shown) and may effectuate the displacement of the sliding cam, so that different operating states, such as the valve lifts, are achievable on one or multiple valves. The combustion behavior in a cylinder of an internal combustion engine may therefore change.

Figure 2:
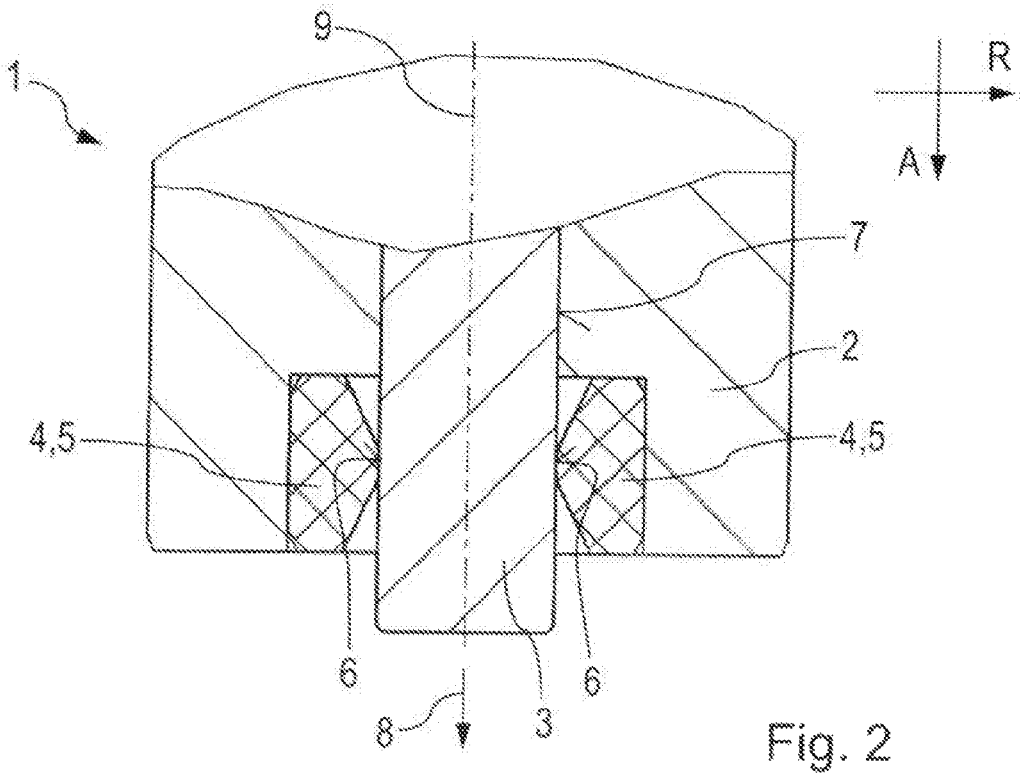
FIG. 2 shows an area II from FIG. 1 in a detailed view.

A sealing element 4 is situated between a component fixed to the housing and a component fixed to the moving pin, sealing element 4 being designed as a wiper ring 5 in the exemplary embodiment illustrated in FIG. 1. It is readily apparent in FIG. 2, that wiper ring 5 tapers to a point radially inward with a symmetrical distribution.

Tips 6 of wiper ring 5 are in sealing contact with peripheral surface 7 of moving pin 3. Sealing element 4 is situated fixedly in housing 2 in the exemplary embodiment illustrated in FIGS. 1 and 2 but is in grinding contact with moving pin 3, so that moving pin 3 extends in the direction of arrow 8, which indicates the extending direction of. An axis 9 is the longitudinal axis of the sliding cam actuator and at the same time indicates the axial direction.

Figure 3:
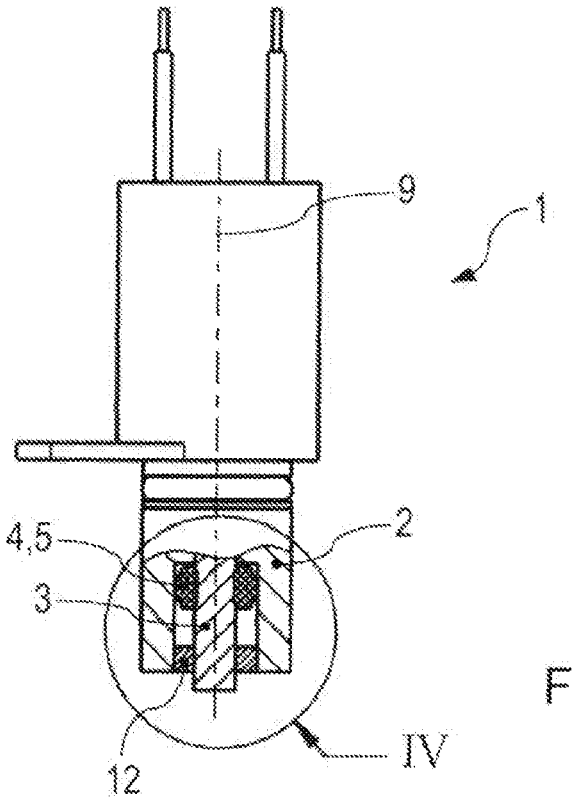
FIG. 3 shows a second specific embodiment in the type of representation of FIG. 1
Figure 4:
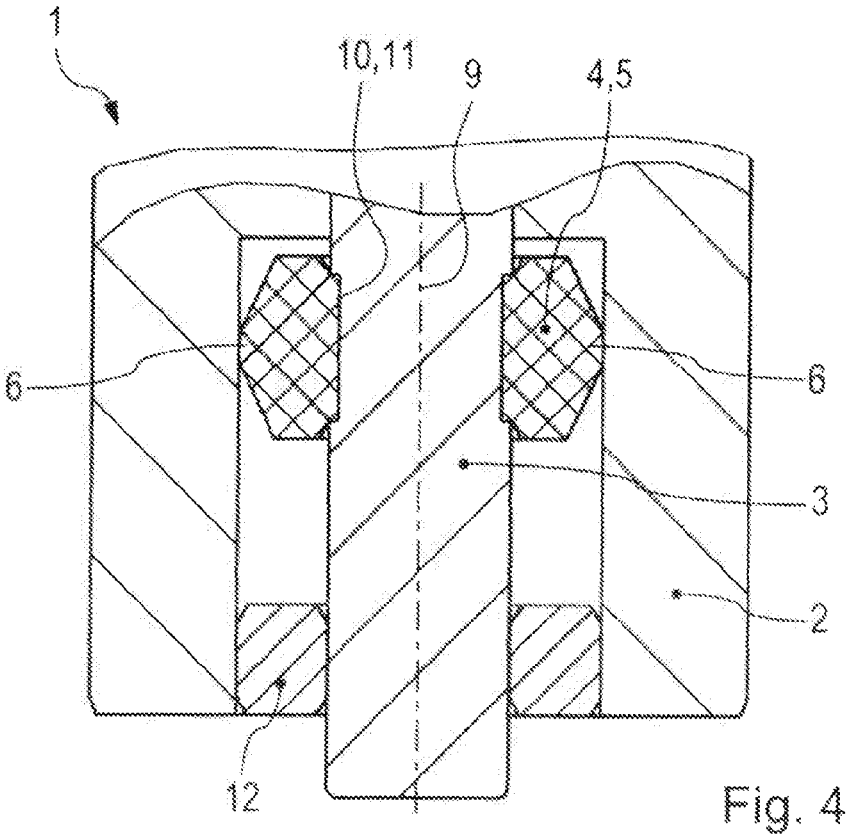
FIG. 4 shows an area IV from FIG. 3 in a detailed view.

The second specific embodiment of a sliding cam actuator 1 according to the present invention is illustrated in FIG. 3, sealing element 4, designed as a wiper ring 5, being fixedly mounted on the moving pin, namely being inserted into a recess 10, which is readily apparent in FIG. 4. Recess 10 is formed as a peripheral groove on the outside of moving pin 3. As is also apparent in FIGS. 3 and 4, a guide element which is designed as a grinding element 12 is additionally mounted on the housing end of sealing element 4 in addition to the moving pin guide.

Wiper ring 5 has a tip 6, which is attached peripherally to the sealing element 4 and is in grinding contact with housing 2

Figure 5:
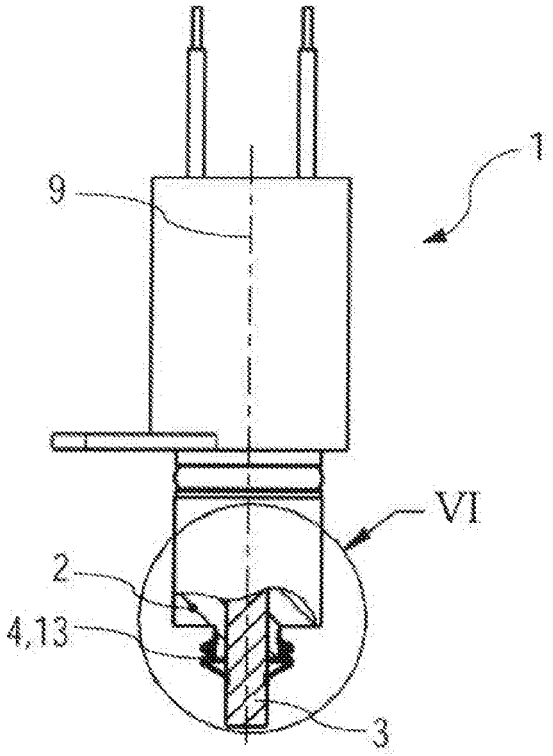
FIG. 5 shows a third specific embodiment in the type of representation of FIG. 1.
Figure 6:
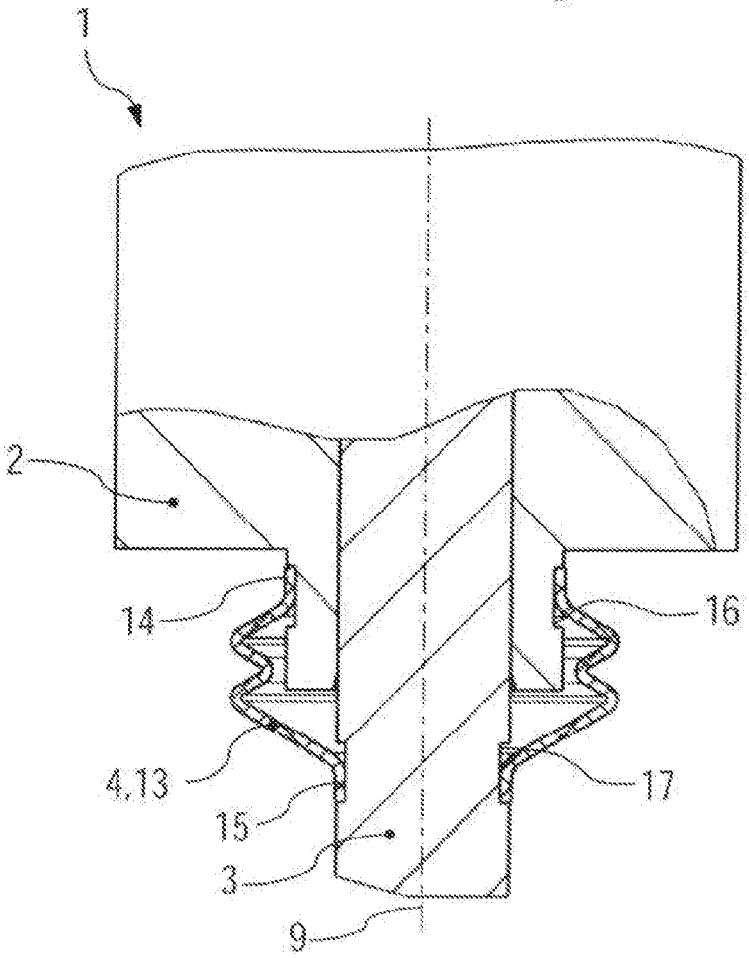
FIG. 6 shows an area VI from FIG. 5 in a detailed view.

FIGS. 5 and 6 illustrate a third exemplary embodiment of a sliding cam actuator 1 according to the present invention, sealing element 4 being designed as bellows 13 here. Bellows 13 has a first end 14, fixedly inserted into a preferably rectangular peripheral notch 16, which may also be referred to as a groove or recess in housing 2. A moving pin groove 17 is formed peripherally over the entire circumference of moving pin 3, a second end 15 of bellows 13 being fixedly inserted into this moving pin groove. Bellows 13 is thus fixedly connected to housing 2 at its first end 14 as well as being fixedly connected to moving pin 3 at its second end 15

Bellows 13 may be made of rubber, metal or a combination of these materials.

LIST OF REFERENCE NUMERALS

1 sliding cam actuator
2 housing
3 moving pin
4 sealing element
5 wiper ring
6 tip
7 peripheral surface
8 extending direction
9 longitudinal axis
10 recess
11 groove
12 grinding element
13 bellows
14 first end of the bellows
15 second end of the bellows
16 notch
17 moving pin groove

What is claimed is:

1. A sliding cam actuator for a sliding cam system, the sliding cam actuator comprising:

a housing defining a housing interior;

at least one coil body situated in the housing interior and including a winding for generating a magnetic force when current flows through the winding;

at least one moving pin or contact pin extendable out of the housing by the magnetic force or a spring force, the moving pin or contact pin for dipping into a sliding groove of a sliding cam; and a seal sealing the housing interior from the outside and situated between a component fixed to the housing and a component fixed to the moving pin or contact pin, wherein the seal is a bellows.

2. The sliding cam actuator as recited in claim 1 wherein the bellows is made of or includes rubber or metal.

3. The sliding cam actuator as recited in claim 1 wherein the bellows is an expandable bellows fixedly mounted on the component fixed to the housing as well as the component fixed to the moving or contact pin, and sealing a gap situated between the component fixed to the housing as well as the component fixed to the moving or contact pin.

4. The sliding cam actuator as recited in claim 1 wherein the component fixed to the housing is the housing or an armature guide, the component fixed to the moving or contact pin being the moving or contact pin or an armature.

5. The sliding cam actuator as recited in claim 4 wherein the armature or the armature guide is fixedly connected to the moving or contact pin or is an integral part thereof.

6. A sliding cam system comprising:

at least one camshaft; and at least one sliding cam situated dispaceably but rotatably fixed on the camshaft and having a sliding groove, the moving or contact pin of the sliding cam actuator as recited in claim 1 engaging into the sliding groove.

* * * * *